US009763524B2

(12) United States Patent
Hopke et al.

(10) Patent No.: US 9,763,524 B2
(45) Date of Patent: Sep. 19, 2017

(54) INFANT CARE APPARATUS

(71) Applicant: Thorley Industries, LLC, Pittsburgh, PA (US)

(72) Inventors: Frederick Karl Hopke, Medway, MA (US); Henry F. Thorne, Sewickley Heights, PA (US); Mary J. Koes, Pittsburgh, PA (US); Robert D. Daley, Pittsburgh, PA (US)

(73) Assignee: Thorley Industries LLC, Pittsburgh, PA (US)

( * ) Notice: Subject to any disclaimer, the term of this patent is extended or adjusted under 35 U.S.C. 154(b) by 0 days.

(21) Appl. No.: 15/170,240

(22) Filed: Jun. 1, 2016

(65) Prior Publication Data

US 2016/0270552 A1 Sep. 22, 2016

Related U.S. Application Data

(63) Continuation of application No. 14/446,803, filed on Jul. 30, 2014, now Pat. No. 9,642,474, which is a continuation of application No. 13/467,604, filed on May 9, 2012, now Pat. No. 8,827,366, which is a continuation of application No. 12/552,607, filed on Sep. 2, 2009, now Pat. No. 8,197,005.

(60) Provisional application No. 61/093,764, filed on Sep. 3, 2008.

(51) Int. Cl.

| | |
|---|---|
| ***A47D 9/02*** | (2006.01) |
| ***A47C 1/00*** | (2006.01) |
| ***A47D 13/10*** | (2006.01) |

(52) U.S. Cl.

CPC ..... *A47D 9/02* (2013.01); *A47C 1/00* (2013.01); *A47D 13/105* (2013.01)

(58) Field of Classification Search

None

See application file for complete search history.

(56) References Cited

U.S. PATENT DOCUMENTS

| | | | |
|---|---|---|---|
| 184,305 | A | 11/1876 | Snyder |
| 475,742 | A | 5/1892 | Palmer |
| 1,032,614 | A | 7/1912 | Lamb |
| 1,449,301 | A | 3/1923 | Shea |
| 1,644,528 | A | 2/1926 | Huff |
| 1,909,204 | A | 6/1930 | Marchese |
| 2,596,033 | A | 8/1949 | King |
| 2,609,029 | A | 7/1950 | Haberstump |
| 2,886,094 | A | 4/1956 | Pickles |
| 3,078,479 | A | 12/1960 | Grosse et al. |
| 3,259,355 | A | 5/1965 | Slouka |
| 3,529,311 | A | 7/1968 | Crawford |

(Continued)

FOREIGN PATENT DOCUMENTS

| | | | |
|---|---|---|---|
| DE | 202005017014 | U1 | 1/2006 |
| JP | 10265140 | A | 10/1998 |
| WO | 2007093986 | A1 | 8/2007 |

*Primary Examiner* — David E Allred

(74) *Attorney, Agent, or Firm* — The Webb Law Firm

(57) ABSTRACT

An infant care apparatus includes a base; a drive mechanism disposed on the base; a controller electronically coupled to the drive mechanism; and a support device coupled to the drive mechanism. The support device is configured to be moved in both a horizontal and vertical direction relative to the base by the drive mechanism. The drive mechanism is controlled by the controller to move the support device in a plurality of motion profiles relative to the base.

20 Claims, 14 Drawing Sheets

(56) References Cited

U.S. PATENT DOCUMENTS 3,608,855 A 9/1971 Osenberg
3,653,080 A 4/1972 Hafele
3,700,203 A 10/1972 Adams
3,993,280 A 11/1976 Surbaugh
3,999,799 A * 12/1976 Daswick ..... A47C 3/0257 297/270.3
4,057,289 A 11/1977 Jones
4,092,009 A 5/1978 Koutsky
4,128,273 A 12/1978 Jones
4,258,446 A 3/1981 McAllister et al.
4,430,992 A 2/1984 Christ
4,491,365 A 1/1985 Murakami
4,531,459 A 7/1985 Yamada
4,555,138 A 11/1985 Hughes
4,620,334 A 11/1986 Robinson
4,752,102 A 6/1988 Rasmussen
4,752,980 A 6/1988 Nafte
4,786,024 A 11/1988 Goetz
4,941,709 A * 7/1990 Moller ..... A61B 6/04 297/311
4,970,740 A 11/1990 Crawford
4,988,300 A 1/1991 Yamaguchi et al.
5,022,708 A 6/1991 Nordella et al.
5,107,555 A 4/1992 Thrasher
5,112,018 A 5/1992 Wahls
5,183,457 A 2/1993 Gatts et al.
5,251,864 A 10/1993 Itou
5,257,851 A 11/1993 Kanaya
5,303,433 A 4/1994 Jang
5,342,113 A 8/1994 Wu
5,451,095 A 9/1995 Riback
5,463,961 A 11/1995 Graves
5,527,221 A 6/1996 Brown et al.
5,586,740 A 12/1996 Borlinghaus et al.
5,618,262 A 4/1997 Rene
5,711,045 A 1/1998 Caster et al.
5,765,916 A 6/1998 Patel
5,845,350 A 12/1998 Beemiller et al.
5,935,012 A 8/1999 Cohn et al.
5,967,609 A * 10/1999 Potter ..... A47C 1/027 297/261.3
6,068,566 A 5/2000 Kim
6,089,667 A 7/2000 Hobbs
6,367,758 B1 4/2002 Garrido et al.
6,378,940 B1 4/2002 Longoria et al.
6,488,640 B2 12/2002 Hood, Jr. et al.
6,519,792 B2 2/2003 Chen
6,574,806 B1 6/2003 Maher
6,677,720 B2 1/2004 Fraser
6,698,431 B1 3/2004 Harris et al.
6,808,458 B1 10/2004 Jung
6,966,082 B2 11/2005 Bloemer et al.
6,971,127 B2 12/2005 Richards
7,395,560 B2 7/2008 Bloemer et al.
7,485,086 B2 2/2009 Dickie
7,717,798 B2 5/2010 Bellows et al.
7,722,118 B2 5/2010 Bapst et al.
7,780,230 B2 * 8/2010 Serber ..... B60N 2/0745 297/216.1
7,845,728 B2 12/2010 Chen et al.
7,958,579 B2 6/2011 Westerkamp et al.
8,046,851 B2 * 11/2011 Ahlman ..... A61B 6/0442 5/613
8,047,609 B2 11/2011 Chen et al.
8,474,848 B2 * 7/2013 Bernatsky ..... A61G 5/1062 280/250.1
9,399,415 B2 * 7/2016 Serber ..... B60N 2/0745
2002/0113469 A1 8/2002 Stern et al.
2005/0091743 A1 5/2005 Bloemer et al.
2006/0012230 A1 1/2006 Kennedy et al.
2006/0031985 A1 2/2006 Bloemer et al.
2007/0205646 A1 9/2007 Bapst et al.
2007/0293373 A1 12/2007 Nakanishi
2008/0136236 A1 6/2008 Kincaid et al.
2008/0179928 A1 7/2008 Chen et al.
2010/0164264 A1 7/2010 Zadai et al.
2011/0275444 A1 11/2011 Tirelli
2012/0319968 A1 12/2012 Sakayori

* cited by examiner

INFANT CARE APPARATUS

CROSS REFERENCE TO RELATED APPLICATIONS

This application is a continuation of U.S. patent application Ser. No. 14/446,803, filed Jul. 30, 2014, which is a continuation of U.S. patent application Ser. No. 13/467,604, filed May 9, 2012, now U.S. Pat. No. 8,827,366 issued Sep. 9, 2014, which is a continuation of U.S. patent application Ser. No. 12/552,607, filed Sep. 2, 2009, now U.S. Pat. No. 8,197,005, issued Jun. 12, 2012, which claims the benefit of priority from U.S. Provisional Patent Application No. 61/093,764, filed Sep. 3, 2008, all of which are hereby incorporated by reference in their entirety.

BACKGROUND OF THE INVENTION

Field of the Invention

The present invention relates generally to an infant care apparatus and, more particularly, to a seat for an infant or baby that can be moved by a drive mechanism.

Description of Related Art

Baby swings and bouncy seats have been used to hold, comfort, and entertain infants and babies for many years. Prior art bouncy seats are normally constructed with a wire frame that contains some resistance to deformation that is less than or equal to the weight of the child in the seat. Thus, when the child is placed in the seat, his or her weight causes a slight and temporary deformation in the wire structure that is then counteracted by the wire frame's resistance to deformation. The end result is that the child moves up and down slightly relative to the floor. This motion can be imparted to the seat by a caregiver for the purpose of entertaining or soothing the child.

Baby swings normally function in much the same way as swing sets for older children; however, the baby swing usually has an automated power-assist mechanism that gives the swing a "push" to continue the swinging motion in much the same way a parent will push an older child on a swing set to keep them swinging at a certain height from the ground.

There are some products that have recently entered the market that defy easy inclusion into either the bouncy or swing category. One such product includes a motorized motion that can move the infant laterally, but only has a single degree of motorized freedom and is thus limited in the motion profiles that can be generated. While the seat can be rotated so that the baby is moved back and forth in a different orientation, there remains only one possible motion profile.

A need exists for a motorized infant chair that is capable of simultaneous or independent movement in two dimensions, and can reproduce a large number of motion profiles with those two dimensions to both better mimic the motion of a parent or caregiver.

SUMMARY OF THE INVENTION

Described herein is a motorized infant chair that is capable of simultaneous or independent movement in at least two dimensions, and can reproduce a large number of motion profiles with those at least two dimensions to better mimic the motion of a parent or caregiver.

Accordingly, in one embodiment, an infant care apparatus includes a base; a drive mechanism coupled to the base; a controller electronically coupled to the drive mechanism; and a support device coupled to the drive mechanism. The support device is configured to be moved in both a horizontal and vertical direction relative to the base by the drive mechanism. The drive mechanism is controlled by the controller to move the support device in a plurality of motion profiles relative to the base.

The controller may be mounted within the base, and may include a user interface configured to receive input from the user for controlling the movement of the drive mechanism. Each of the plurality of motion profiles may include both horizontal and vertical movements.

The drive mechanism may include a horizontal reciprocating assembly and a vertical reciprocating assembly disposed on the horizontal reciprocating assembly. The horizontal reciprocating assembly may include a first motor having a drive shaft; a slide crank assembly comprising a gearing assembly coupled to the drive shaft of the first motor and a crank member coupled to the gearing assembly; and a sliding stage coupled to the crank member. Operation of the first motor may cause rotation of the slide crank assembly, thereby imparting reciprocating horizontal motion to the sliding stage. The vertical reciprocating assembly includes a second motor having a drive shaft; a worm gear assembly coupled to the output of the drive shaft; and a vertical yoke having a first end coupled to an output shaft of the worm gear assembly. Operation of the second motor may cause rotation of the vertical yoke, thereby imparting reciprocating vertical motion to the support device. The vertical reciprocating assembly may further include a dual scissor mechanism coupled to a second end of the vertical yoke configured to support the support device.

Accordingly, the first motor provides horizontal motion to the support device and the second motor provides vertical motion to the support device. A first encoder having a single slot may be coupled to a drive shaft of the first motor and a second encoder having a single slot may be coupled to the drive shaft of the second motor. The controller may determine position information of the support device based at least in part on information from the first encoder and the second encoder. The control system may also include two positional sensors to indicate when the vertical reciprocating assembly is in its lowest position and when the horizontal reciprocating assembly is at its furthest point to the right when viewed from the front.

The support device may include a seat support tube coupled to the drive mechanism; a substantially elliptical seating portion coupled to a first end and a second end of the seat support tube; and a toy bar having a first end coupled to the second end of the seat support tube and a second end extending over the seating portion. The position of the seating portion of the support device may be adjusted by sliding the seat support tube within the drive mechanism and locking the seat support tube in a desired position. The first end of the toy bar may include a curved surface that corresponds to a curved surface of the second end of the seat support tube, thereby causing the second end of the toy bar to be centered over the seating portion when the first end of the toy bar is coupled to the second end of the seat support tube.

Further disclosed is a method of controlling an infant care apparatus. The method may include the steps of providing an infant care apparatus having a base, a drive mechanism coupled to the base, a controller electronically coupled to the drive mechanism, and a support device coupled to the drive mechanism; providing a first encoder coupled to a drive shaft of a first motor of the drive mechanism; and providing a second encoder coupled to a drive shaft of a second motor of the drive mechanism. The first motor is configured to provide horizontal movement to the drive mechanism, and the second motor is configured to provide vertical movement to the drive mechanism. The method also includes the steps of transmitting positional information from the first and second encoders to the controller; determining the position of the drive mechanism based on the positional information; and moving the support device in at least one motion profile relative to the base.

The first encoder and the second encoder may each include no more than one slot. Each of the plurality of motion profiles may include movement of the support device in a horizontal directional and a vertical direction relative to the base. The movement of the support device in the horizontal direction and the movement of the support device in the vertical direction may be coordinated such that a repeatable, visually distinctive motion profile is obtained.

The support device may be moved relative to the base in a plurality of motion profiles. Each of the plurality of motion profiles may be predetermined and one of the plurality of motion profiles is selected by a user. A speed of the first motor and the second motor may be adjustable by the controller.

Also disclosed is an infant care apparatus that includes a drive mechanism and a support device coupled to the drive mechanism. The drive mechanism is configured to move the support device in a plurality of motion profiles each comprising both vertical and horizontal movement of the support device.

Further disclosed is an infant care apparatus that includes a base; a drive mechanism coupled to the base; a controller electronically coupled to the drive mechanism; and a support device coupled to the drive mechanism. The support device is configured to be moved in both a horizontal and vertical direction relative to the base by the drive mechanism. The movements of the support device in the horizontal and vertical directions are independently controlled by the controller.

Movements of the support device in the horizontal and vertical directions may be coordinated to obtain at least one motion profile. The support device may be moved in the vertical direction a maximum of about 1.5 inches and the support device may be moved in the horizontal direction a maximum of about 3.0 inches. Movement in the vertical direction may have a frequency range of between about 10 and 40 cycles per minute and movement in the horizontal direction may have a frequency range of between about 10 and 40 cycles per minute.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PRESENT INVENTION

Figure 1:
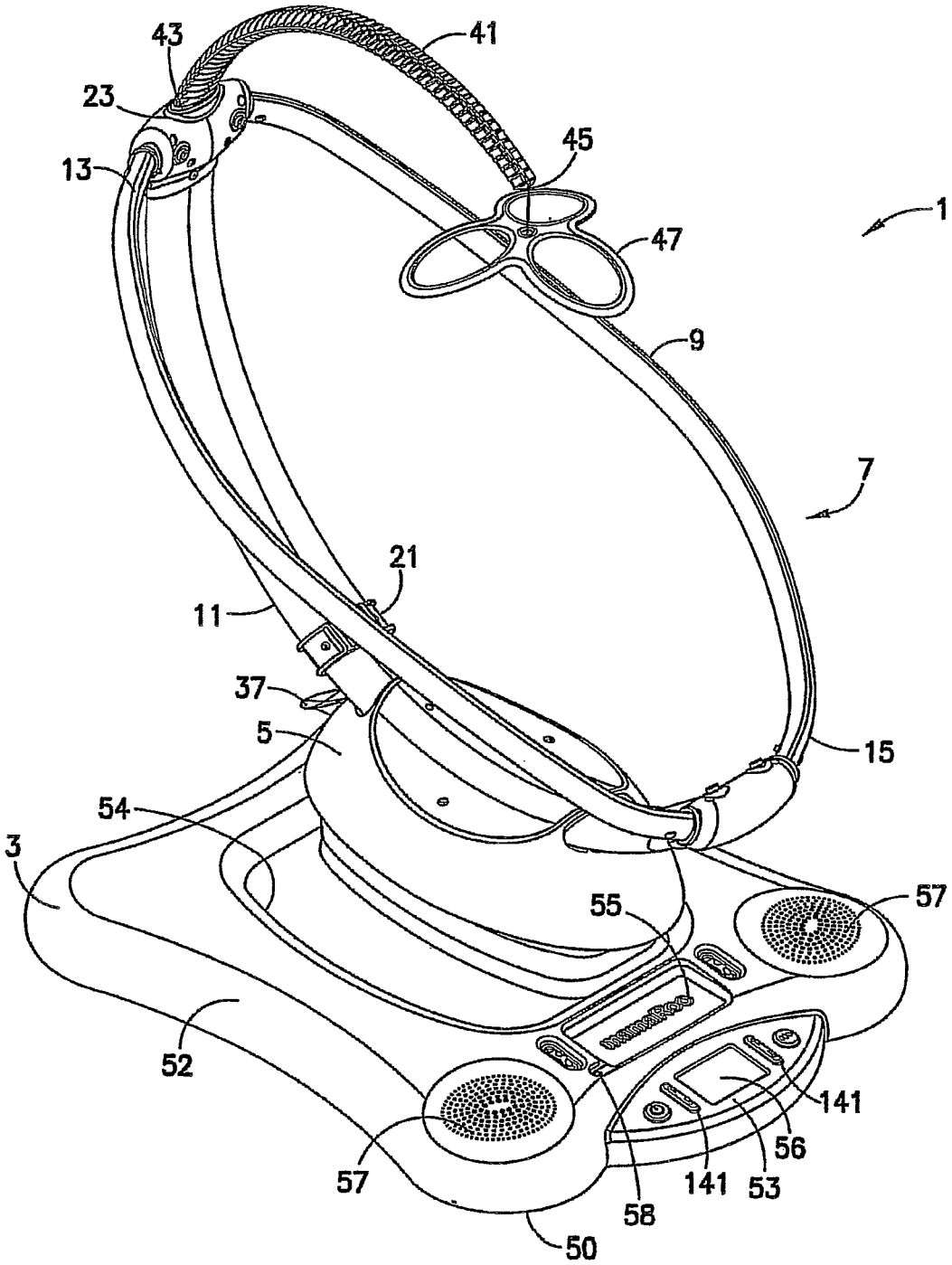
FIG. 1 is a perspective view of an infant care apparatus in accordance with one embodiment.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

An infant care apparatus according to one embodiment is shown in FIGS. 1-14.

Figure 2:
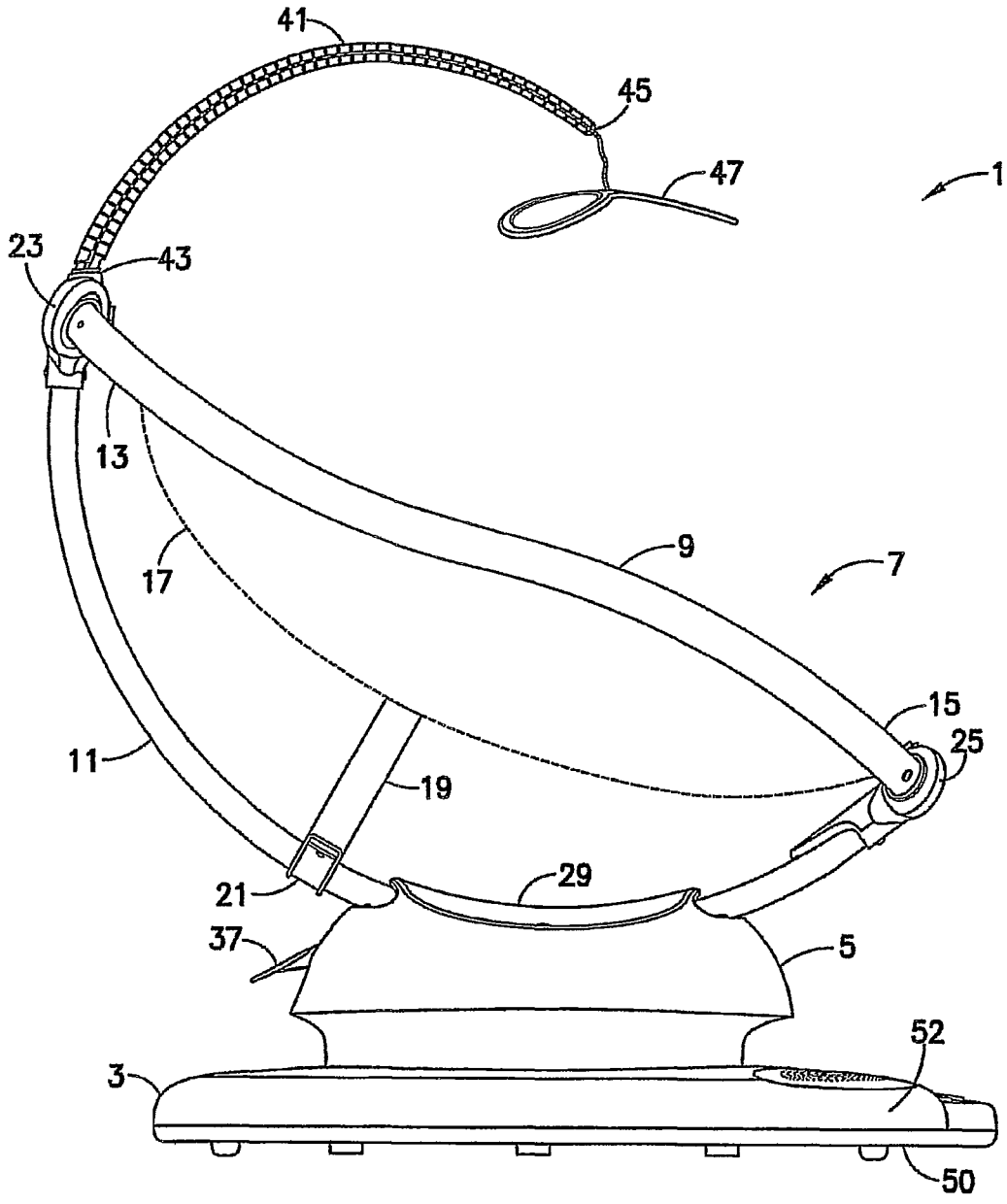
FIG. 2 is a side view of the infant care apparatus of FIG. 1.
Figure 3:
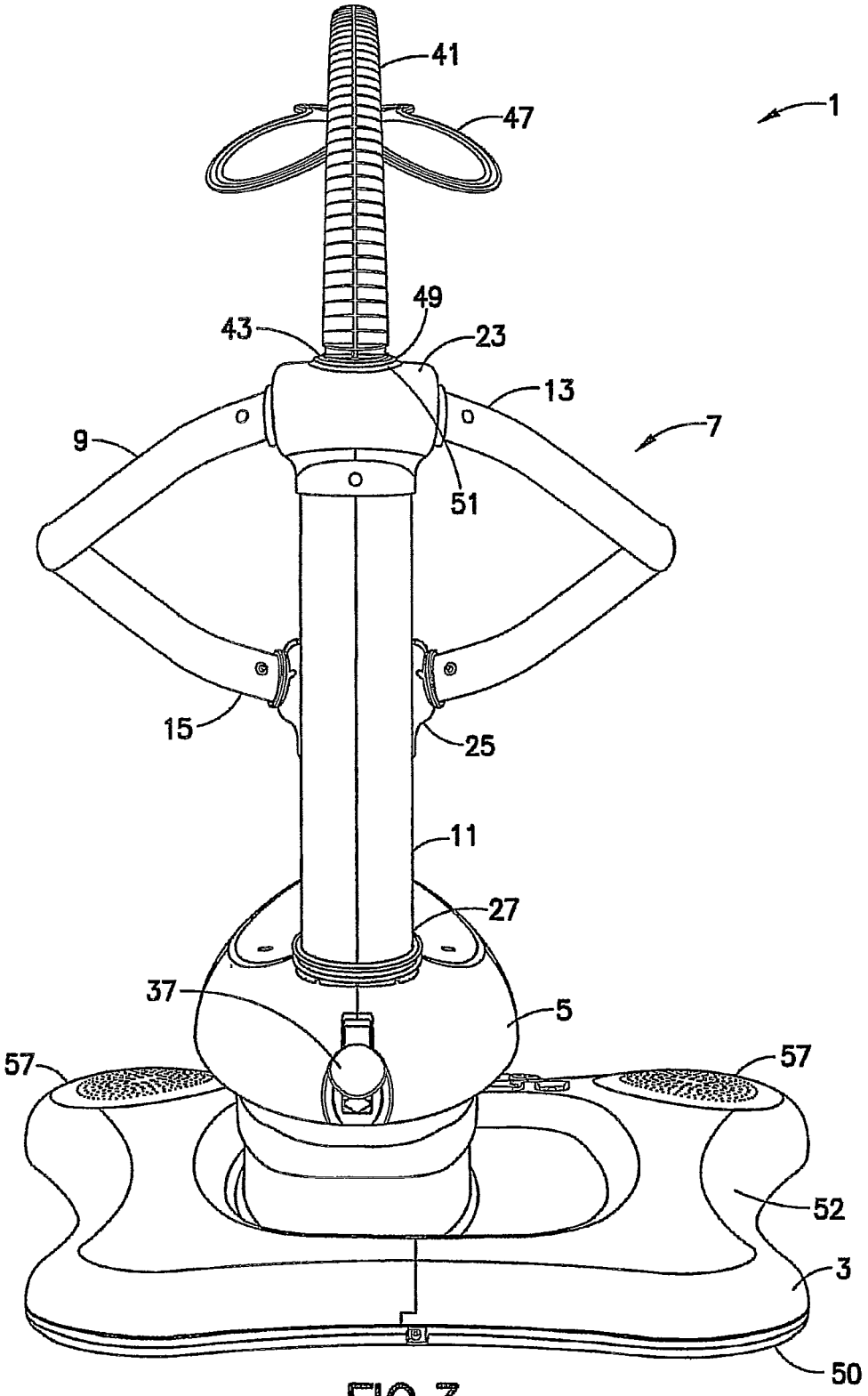
FIG. 3 is a rear view of the infant care apparatus of FIG. 1.
Figure 4:
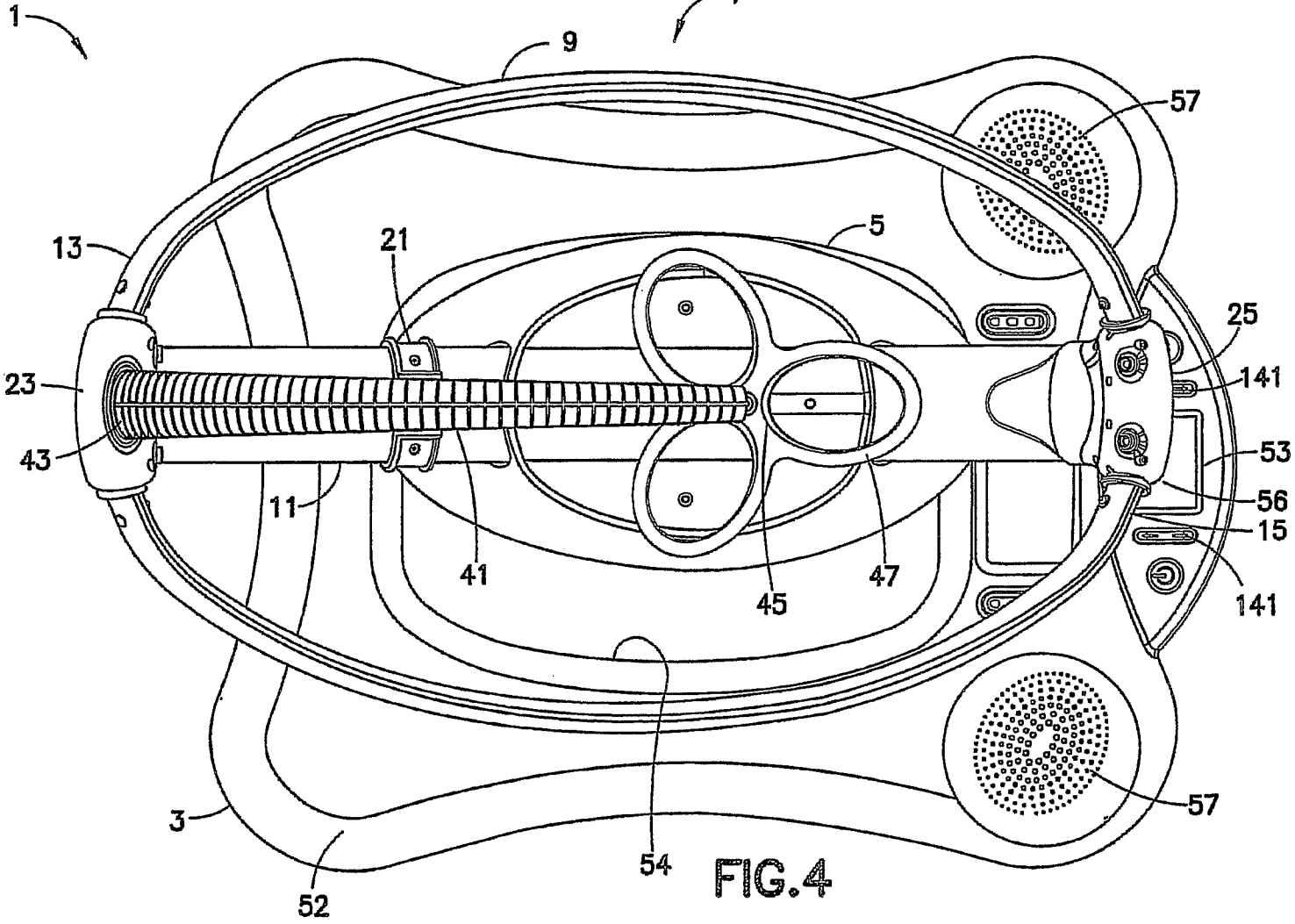
FIG. 4 is a top plan view of the infant care apparatus of FIG. 1.

With reference to FIGS. 1-4, an infant care apparatus, denoted generally as reference numeral 1, includes a base 3, a drive mechanism positioned within a drive mechanism housing 5 disposed on base 3, and a support device 7 coupled to drive mechanism housing 5. Support device 7 includes a seating portion 9 and a seat support tube 11. Seating portion 9 has a generally elliptical shape having an upper end 13 and a lower end 15 when viewed from above. Seating portion 9 is also shaped to resemble a sinusoidal waveform when viewed from the side as illustrated in FIG. 2.

Seating portion 9 is designed to receive a fabric or other type of comfortable seat 17 for an infant as shown in phantom in FIG. 2. Seat 17 may be coupled to seating portion 9 using zippers, hook and loop fabric, buttons, or any other suitable fastening mechanism. In addition, seat 17 may further include a strap 19 to secure a baby or infant to seat 17 as is well known in the art. Strap 19 is riveted to seat support tube 11 with clips provided on a strap securing member 21. Strap 19 is fed through slots (not shown) provided in seat 17 to connect into the crotch support (not shown) of seat 17 to secure the child. By securing strap 19 to seat support tube 11, the baby or infant positioned on seat 17 is prevented from leaning forward and falling out of seat 17. In addition, strap 19 can be easily removed from strap securing member 21 by a parent or care provider so that seat 17 can be removed for cleaning or replacement. Seat 17 is desirably manufactured in a variety of colors and patterns such that a parent or care provider can change the aesthetic look of infant care device 1 by interchanging seat 17 without replacing infant care device 1.

Figure 5:
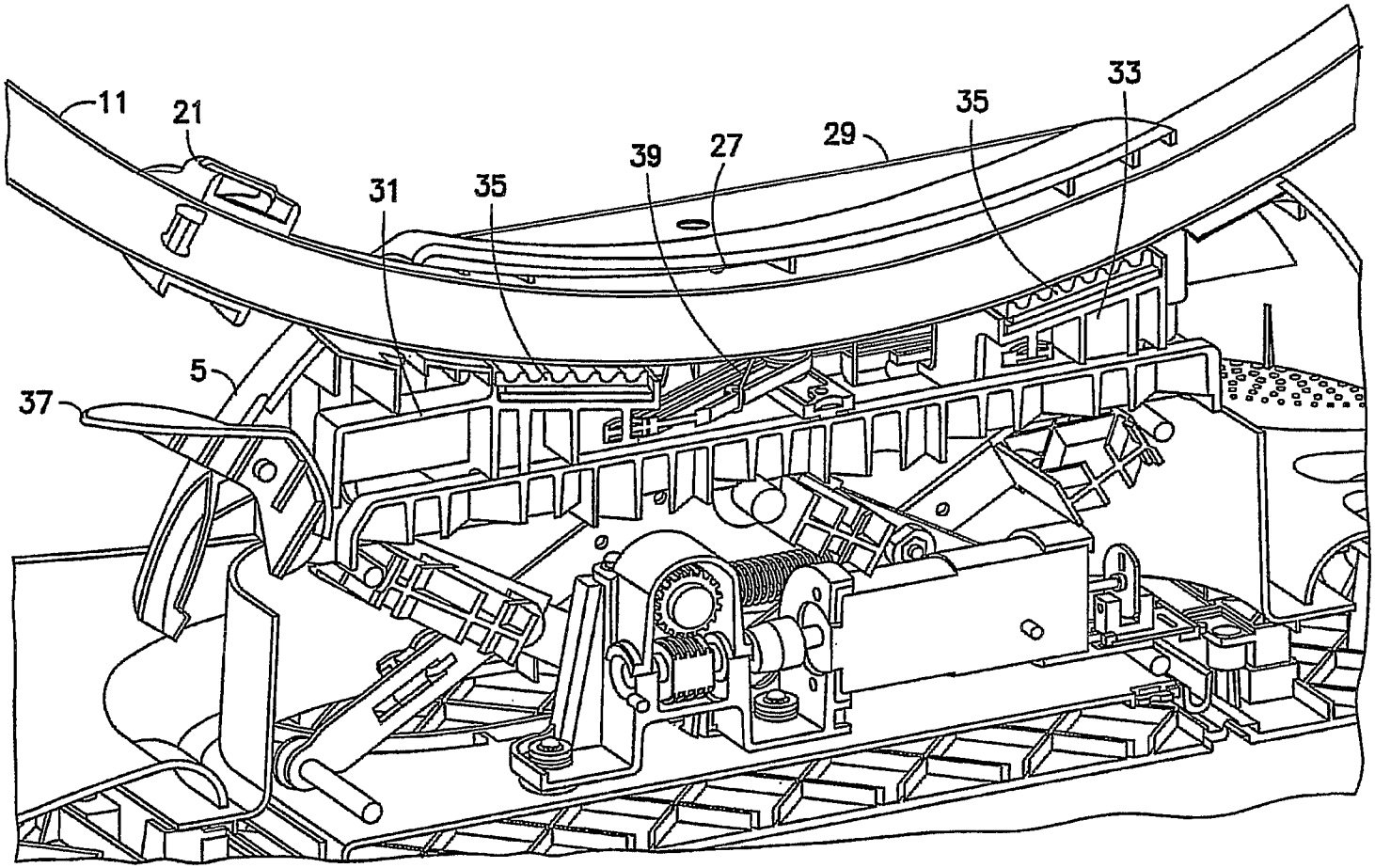
FIG. 5 is a cross-sectional view of a portion of the infant care apparatus of FIG. 1.

Seat support tube 11 is connected to upper end 13 of seating portion 9 via an upper connector 23 and curvedly extends away from the upper connector 23 toward lower end 15 of seating portion 9 where it is coupled to a lower connector 25. With reference to FIG. 5, and with continued reference to FIGS. 1-4, seat support tube 11 is supported by, and slidingly engaged with, a curved passage 27 in an upper portion 29 of drive mechanism housing 5 between upper connector 23 and lower connector 25. A rear recline locker 31 and forward recline locker 33 are also positioned within upper portion 29 of drive mechanism housing 5. Rear recline locker 31 and forward recline locker 33 each include a locking pad 35. Locking pads 35 are manufactured from rubber or any other suitable material. Rear recline locker 31 and forward recline locker 33 are configured to removably engage locking pads 35 with the portion of seat support tube 11 positioned within curved passage 27 by movement of a camming mechanism 37 extending from upper portion 29 of drive mechanism housing 5. Camming mechanism 37 is mechanically coupled to rear recline locker 31, and rear recline locker 31 is coupled to front recline locker 33 by a linkage 39 such that movement of camming mechanism 37 causes movement of both rear recline locker 31 and forward recline locker 33.

In operation, a user pushes up on camming mechanism 37 and slides seat support tube 11 within curved passage 27 until a desired position for seating portion 9 is reached. The user then pushes down on camming mechanism 37 causing rear recline locker 31 to move forward and forward recline locker 33 to move back. This has the effect of sandwiching seat support tube 11 between an upper surface of curved passage 27 and locking pads 35 of rear recline locker 31 and forward recline locker 33. This allows the orientation of seating portion 9 to be easily altered for the comfort of the infant or baby seated therein. A seat recline security switch 40 (see FIG. 6) is provided to detect whether a user has correctly locked seating portion 9 using camming mechanism 37. If the user has failed to correctly lock seating portion 9, a message will be displayed on a display 56 of a control panel 53 and the user will be prevented from starting infant care apparatus 1.

In addition, a toy bar 41 is also provided as shown in FIGS. 1-4. Toy bar 41 includes a first end 43 coupled to upper connector 23 and a second end 45 extending over seating portion 9. Second end 45 of toy bar 41 may include a toy hanger 47 disposed thereon for mounting one or a plurality of toys (not shown) to entertain the infant. First end 43 of toy bar 41 has a curved surface 49 that corresponds to a curved surface 51 of second end 45 of seat support tube 11 (see FIG. 3), thereby causing second end 45 of toy bar 41 to be centered over seating portion 9 when first end 43 of toy bar 41 is coupled to second end 45 of seat support tube 11.

Base 3 includes a bottom support housing 50 with a top enclosure 52 positioned over and covering bottom support housing 50. The drive mechanism is supported on bottom support housing 50 and extends from an opening 54 in top enclosure 52. Base 3 houses control panel 53 coupled to a controller for viewing and controlling the speed and motion of the drive mechanism as will be described in greater detail hereinafter. Base 3 may further include a portable music player dock 55, with speakers 57 and an input jack 58, for playing music or other pre-recorded soothing sounds. Control panel 53 may also have display 56 to provide information to the user as to motion profile, volume of music being played through speakers 57, and speed of the reciprocation motion, for example.

Figure 6:
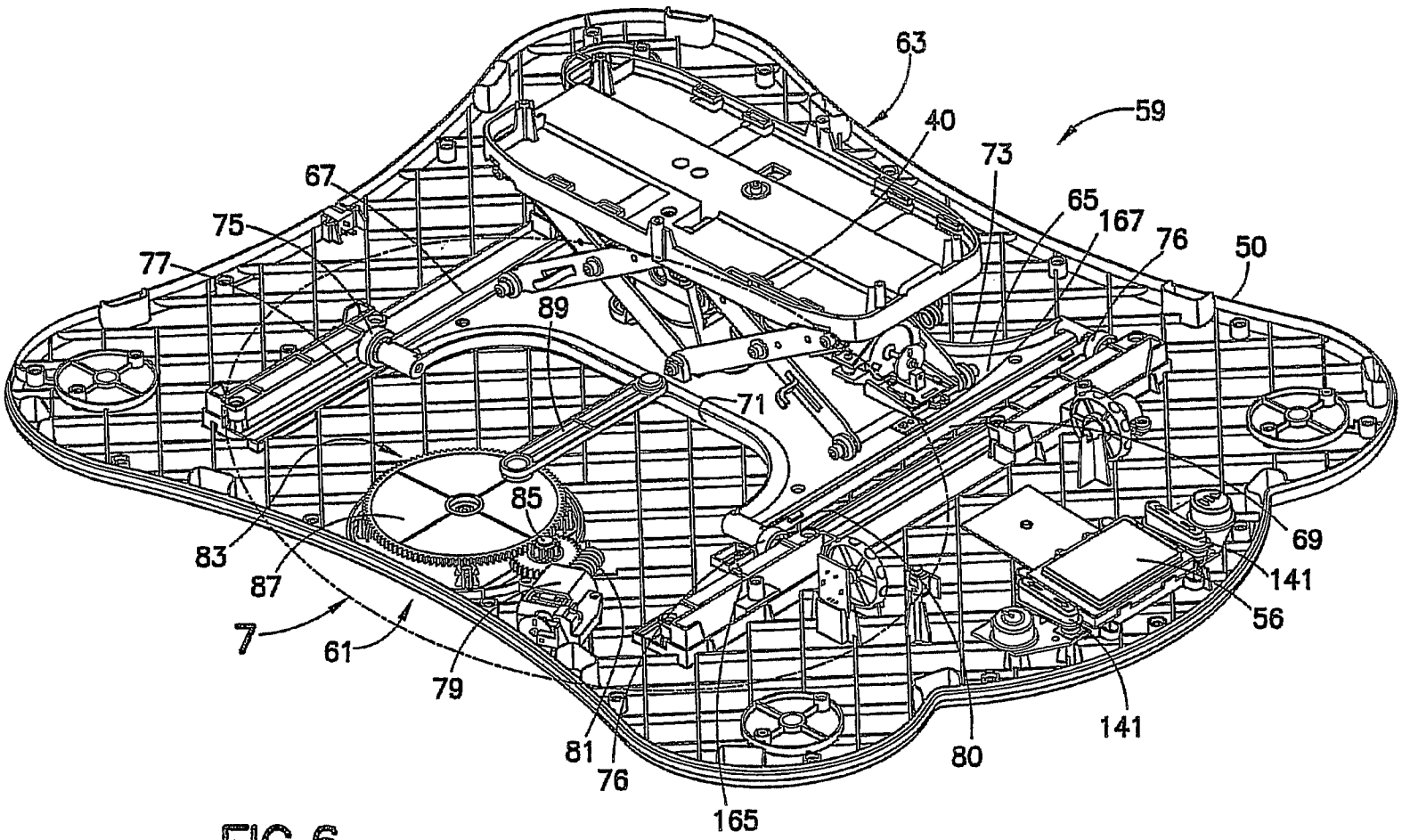
FIG. 6 is a perspective view of the infant care apparatus of FIG. 1 with a seat frame, seat support plate, drive mechanism cover, and top base cover removed illustrating both the horizontal and vertical reciprocating assemblies.
Figure 7:
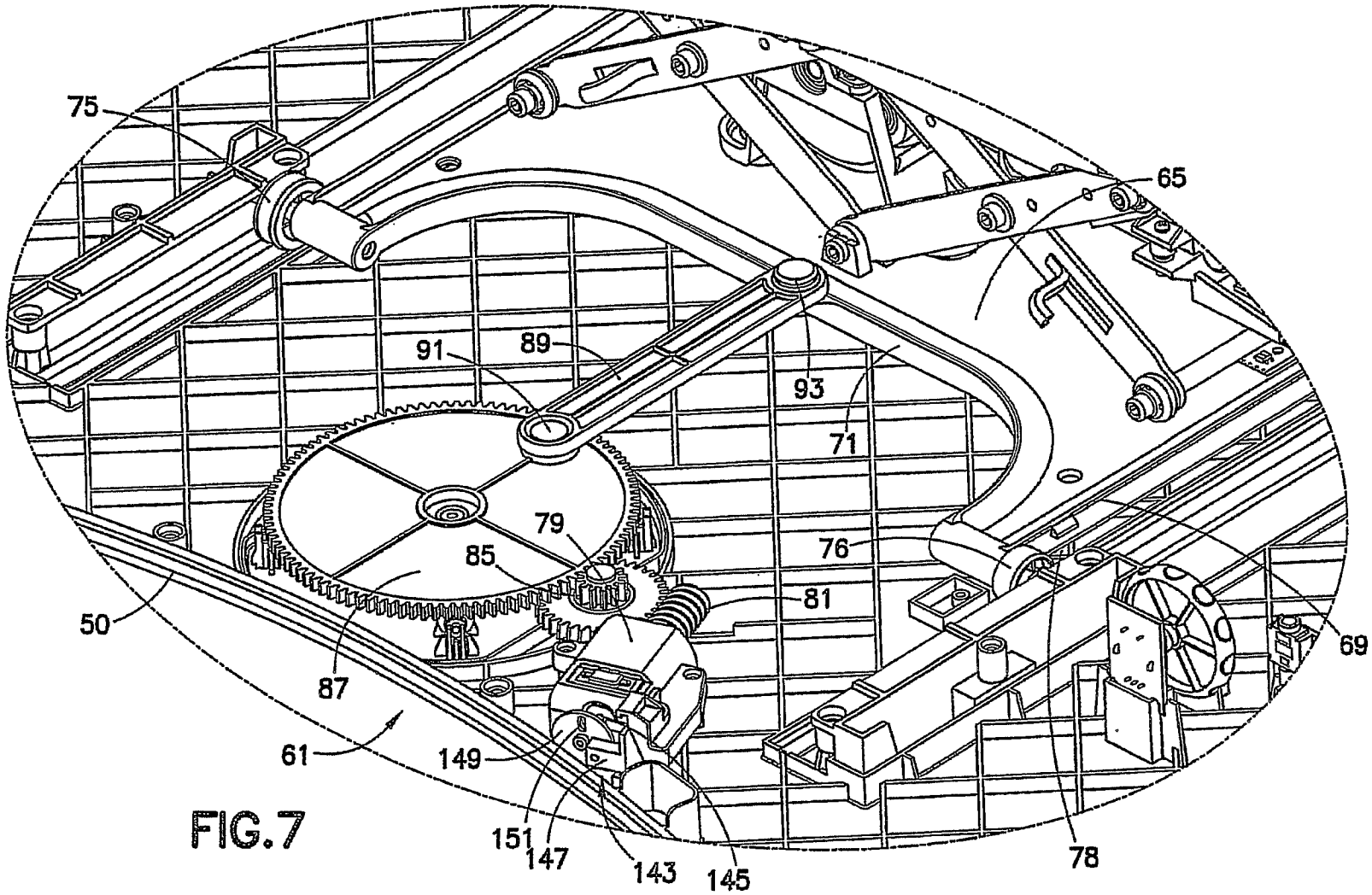
FIG. 7 is a perspective view of a portion of FIG. 6 enlarged for magnification purposes.

With reference to FIGS. 6-7, and with continuing reference to FIGS. 1-5, infant care apparatus 1 further includes a drive mechanism, denoted generally as reference numeral 59, supported by bottom support housing 50 of base 3 and positioned at least partially within drive mechanism housing 5. Drive mechanism 59 includes a horizontal reciprocating assembly 61 for providing horizontal motion and a vertical reciprocating assembly 63 for providing vertical motion.

Horizontal reciprocating assembly 61 includes a rigid platform 65. Rigid platform 65 is generally I-shaped having top and bottom sides 67 and 69, respectively, and left and right sides 71 and 73, respectively. Top side 67 of rigid platform 65 includes at least one grooved wheel 75, and preferably two grooved wheels 75, similar in function and appearance to a pulley wheel, suitably disposed thereon such that top side 67 of rigid platform 65 is rollingly supported by grooved wheels 75. A rail 77 is fixably attached to bottom support housing 50 of base 3. Rail 77 rollingly receives grooved wheels 75 on top side 67 of rigid platform 65. Bottom side 69 of rigid platform 65 includes at least one wheel 76, and preferably two wheels 76, suitably disposed thereon such that bottom side 69 of rigid platform 65 is rollingly supported by wheels 76. A slot 78 is provided to rollingly receive wheels 76 on bottom side 69 of rigid platform 65. Top side 67 is provided with grooved wheels 75 positioned on a rail 77 while bottom side 69 is provided with wheels 76 positioned within a slot 78 to account for any manufacturing error in rigid platform 65. If rigid platform 65 is too long or short, wheels 76 will "float" a slight amount within slot 78 to account for this manufacturing error. Thus, in a preferred embodiment, horizontal reciprocating assembly 61 is capable of rolling back and forth along rail 77 and slot 78, thereby allowing a horizontal displacement of the horizontal reciprocating assembly 61 of approximately three inches.

Horizontal reciprocating assembly 61 further includes a first motor 79 having a drive shaft 81 mounted to bottom support housing 50 and a slide crank assembly, denoted generally as reference numeral 83, also mounted to bottom support housing 50. Slide crank assembly 83 includes a gearing assembly having a set of first gears 85 operationally coupled to drive shaft 81 of first motor 79 and a large second gear 87 operationally coupled to first gears 85. Slide crank assembly 83 further includes a crank member 89 having a first end 91 and a second end 93. First end 91 of crank member 89 is rotationally coupled to a point on the outer circumference of second gear 87, and second end 93 of crank member 89 is fixedly coupled to a point approximately in the center of left side 71 of rigid platform 65. In operation, actuation of first motor 79 causes rotation of first gears 85 which in turn causes rotation of second gear 87. The rotation of second gear 87 causes crank member 89 to either push or pull rigid platform 65 depending on the position of crank member 89. This operation effects a reciprocating horizontal movement of rigid platform 65, along with everything mounted thereon, back and forth along rails 77. Accordingly, this system allows a single motor (i.e., first motor 79) to move rigid platform 65 back and forth with the motor only running in a single direction, thereby eliminating backlash in the system. The system for controlling horizontal reciprocating assembly 61 to achieve the desired motion profile will be discussed in greater detail hereinafter.

With reference to FIGS. 8-12, and with continuing reference to FIGS. 1-7, vertical reciprocating assembly 63 is positioned on rigid platform 65 and is configured to provide vertical movement to support device 7. Vertical reciprocating assembly 63 includes a double scissor mechanism having a first double scissor mechanism 95 operatively coupled to a second double scissor mechanism 97 such that their movement is synchronized. First scissor mechanism 95 and second scissor mechanism 97 are attached between rigid platform 65 and a support platform 99. Various links of left and right double scissor mechanisms 95, 97 have been omitted in FIGS. 8, 9, 11, and 12 for purposes of clarity, however the complete structure of one side of the double scissor mechanism is provided in FIG. 10.

First double scissor mechanism 95 includes a first pair of spaced-apart parallel members 101, 101' and a second pair of spaced-apart parallel members 103, 103'. Second double scissor mechanism 97 includes a third pair of spaced-apart parallel members 105, 105' and a fourth pair of spaced-apart parallel members 107, 107'.

Lower ends 101L of the first pair of spaced-apart parallel members 101, 101' and lower ends 107L of the fourth pair of spaced-apart parallel members 107, 107' are rotatably pinned to each other and to rigid platform 65. Likewise, upper ends 103U, 103U' of second pair of spaced-apart parallel members 103, 103', and upper ends 105U, 105U' of third pair of spaced-apart parallel members 105, 105' are rotatably pinned to each other and to the supporting platform 99.

First and second horizontal bars 109, 111 are provided and extend transversely between lower ends of second pair of spaced-apart parallel members 103, 103', and between lower ends of third pair of spaced-apart parallel members 105, 105', respectively, for additional structural stability. In addition, first and second horizontal bars 109, 111 may further include bearing wheels 113 at their ends for supporting vertical reciprocating assembly 63 and supporting platform 99 and allowing smooth translational movement of first and second horizontal bars 109, 111 during operation.

Still further, third and fourth horizontal bars 115, 117 extend transversely between the upper ends 101U, 101U' of the first pair of spaced-apart parallel members 101, 101', and the upper ends 107U, 107U' of the fourth pair of spaced-apart parallel members 107, 107', respectively. Third and fourth horizontal bars 115, 117 include bearing wheels 119 at their ends for supporting support platform 99.

First pair of spaced-apart parallel members 101, 101' is pivotally secured at a central portion thereof to second pair of spaced-apart parallel members 103, 103' via horizontal pivot pins, or the like. Correspondingly, third pair of spaced-apart parallel members 105, 105' is also pivotally secured at their respective central portions to fourth pair of spaced-apart parallel members 107, 107' via horizontal pivot pins, or the like.

Figure 8:
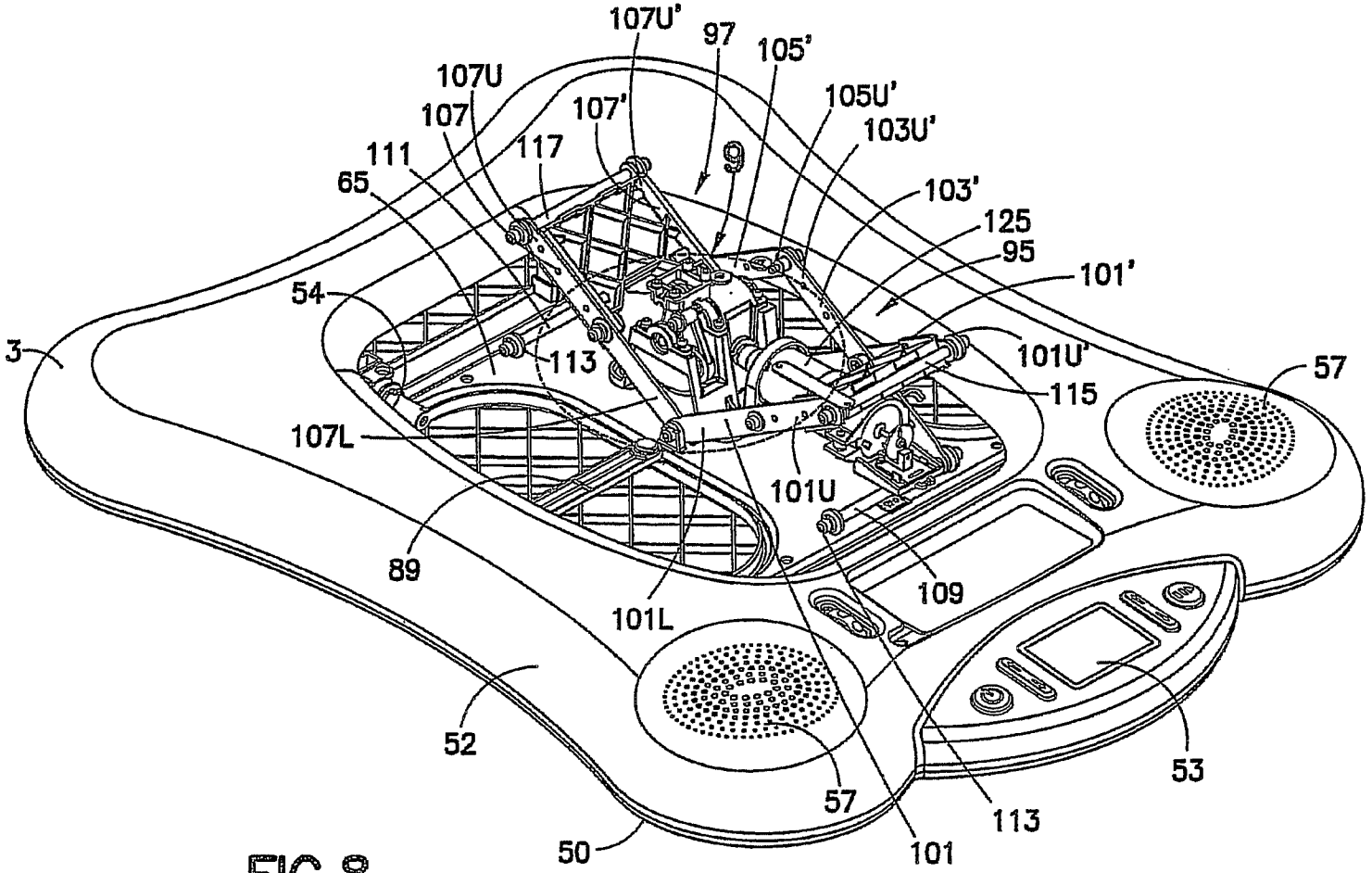
FIG. 8 is a perspective view of the infant care apparatus of FIG. 1 with the seat frame and drive mechanism cover removed, illustrating the vertical reciprocating assembly in a fully lowered position.
Figure 9:
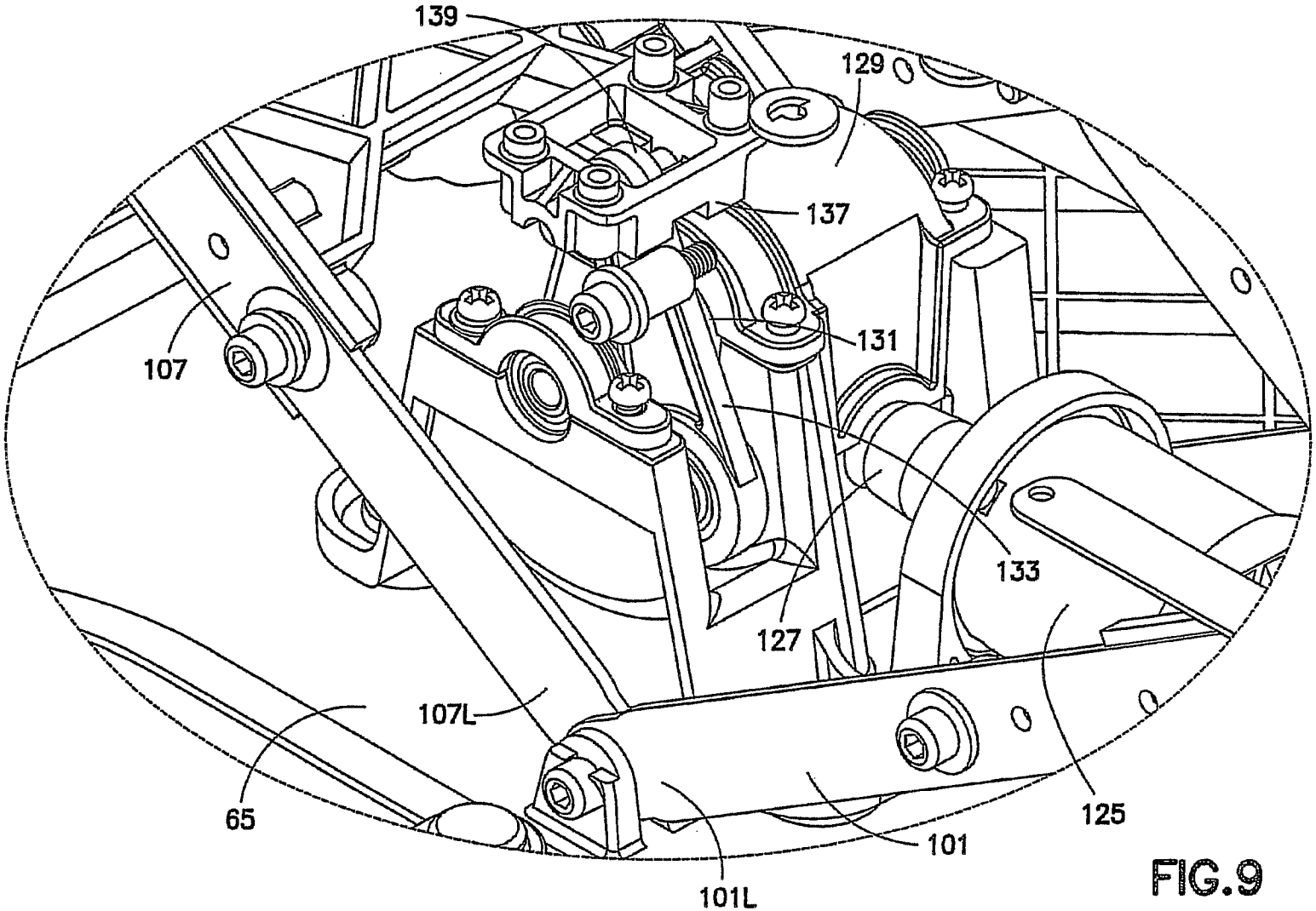
FIG. 9 is a perspective view of a portion of FIG. 8 enlarged for magnification purposes.
Figure 10:
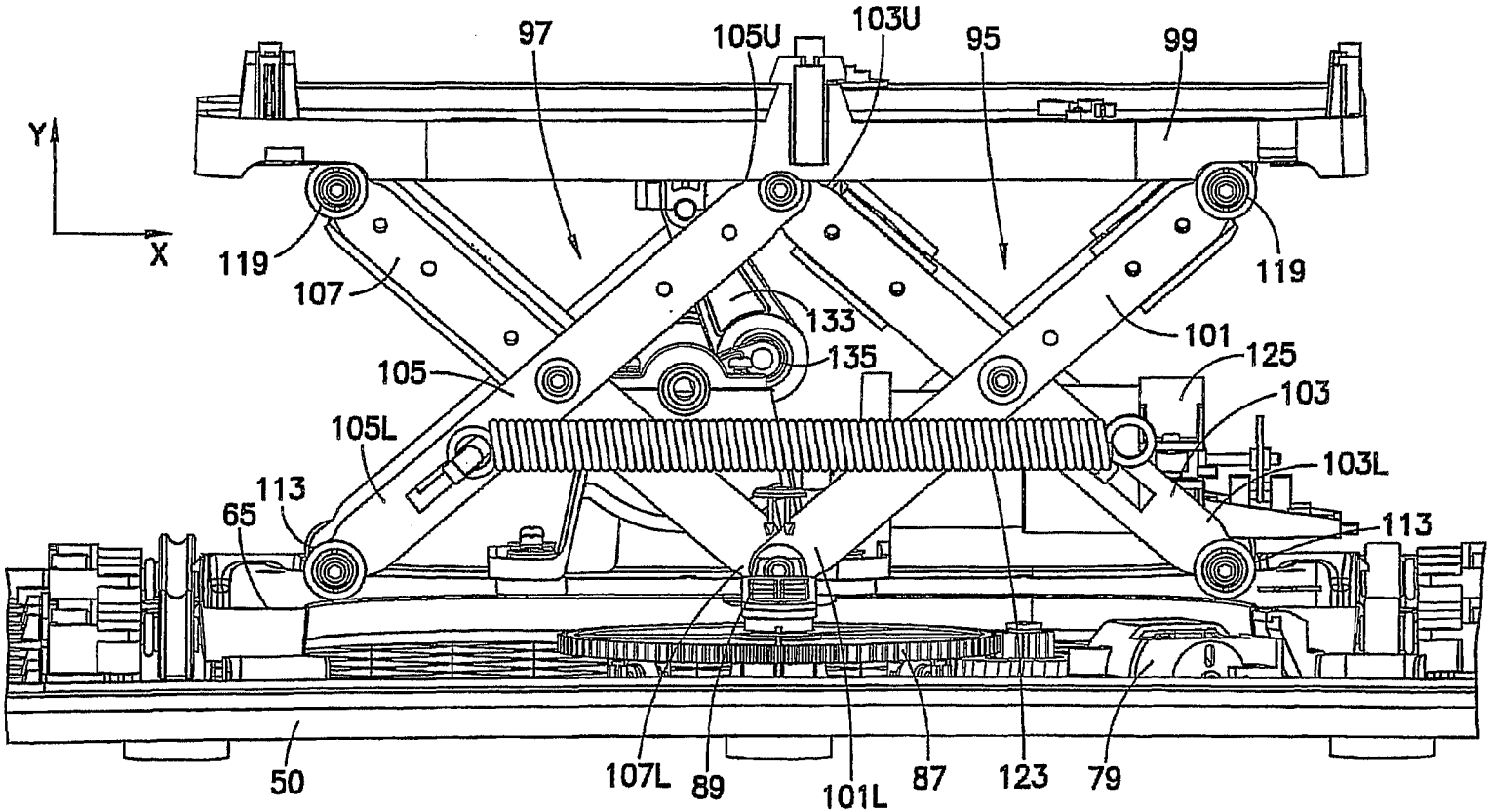
FIG. 10 is a side view showing the horizontal and the vertical reciprocating assemblies of the infant care apparatus of FIG. 1, with the vertical reciprocating assembly in a partially raised position.
Figure 11:
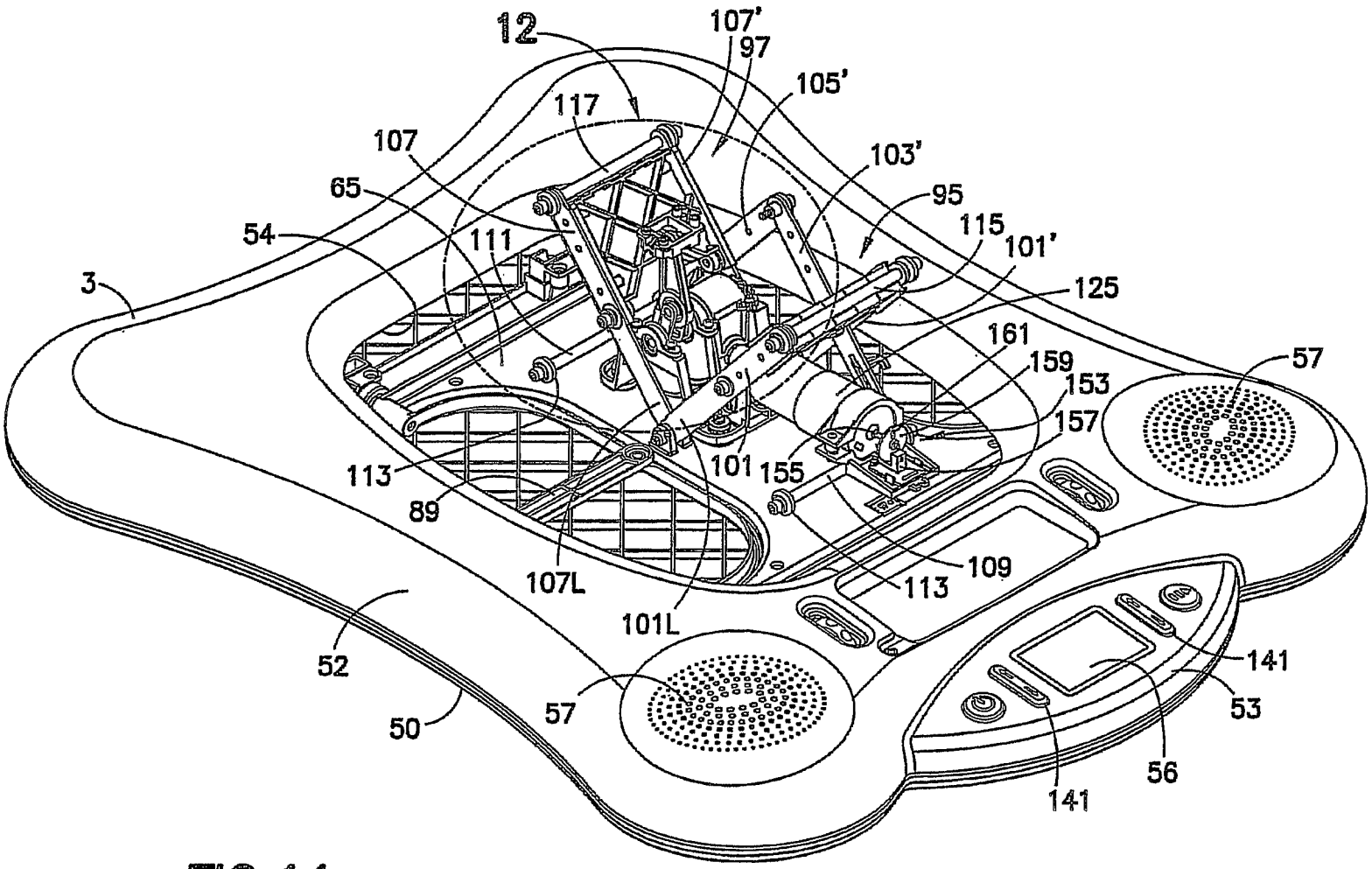
FIG. 11 is a perspective view of the infant care apparatus of FIG. 1 with the seat frame and drive mechanism cover removed, illustrating the vertical reciprocating assembly in a fully raised position.
Figure 12:
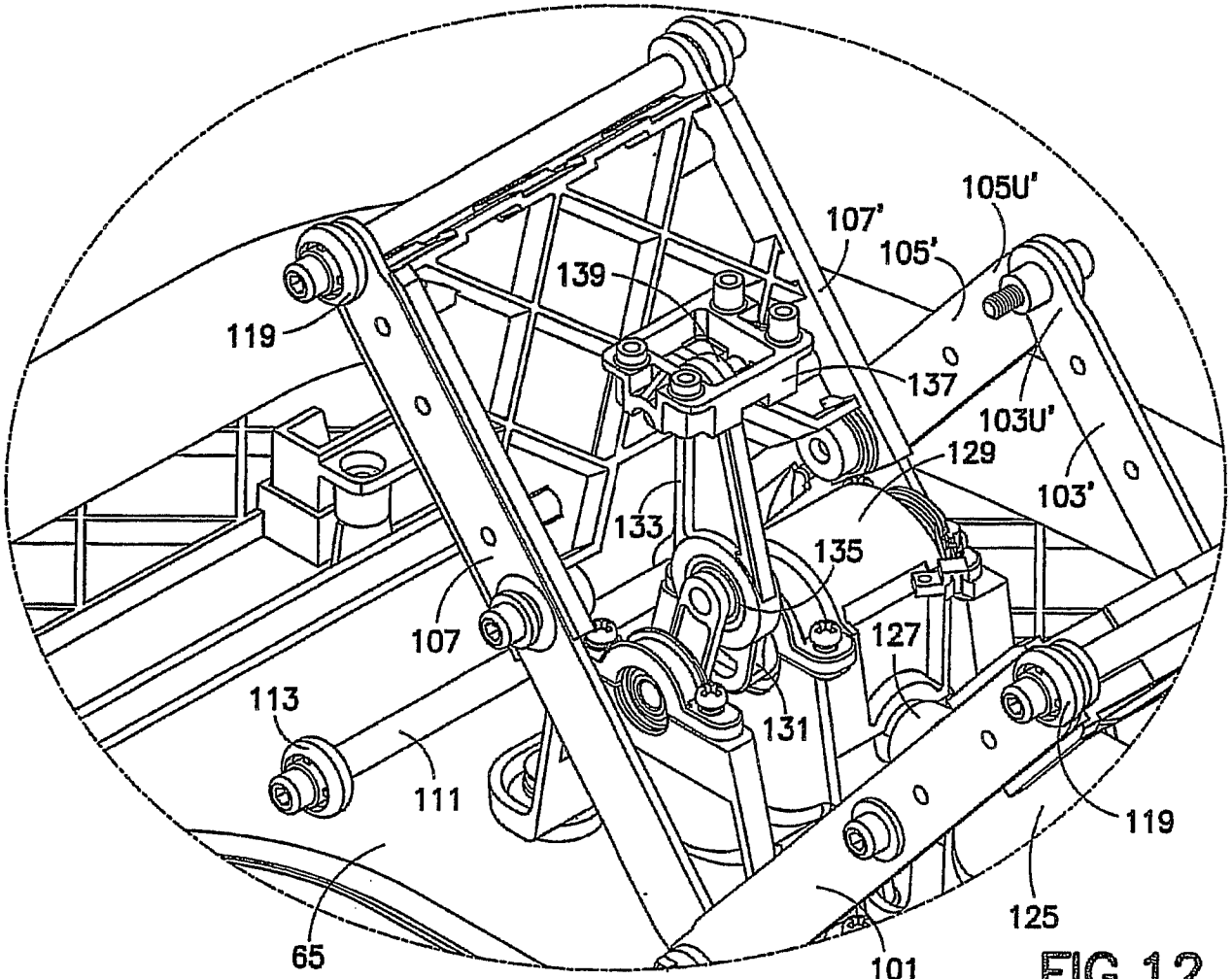
FIG. 12 is a perspective view of a portion of FIG. 11 enlarged for magnification purposes.
Figure 13A:
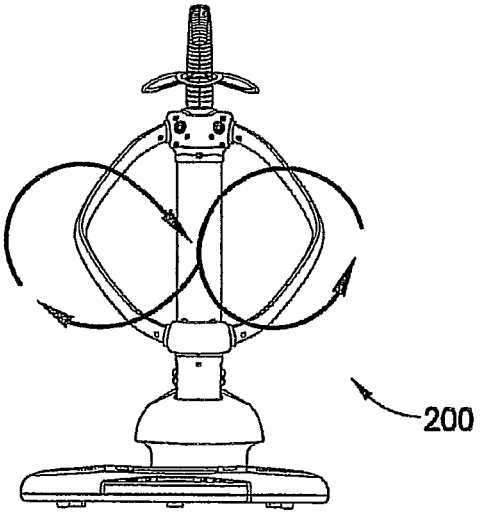
FIGS. 13A through 13E are illustrative diagrams of five representative motion profiles of the present invention.
Figure 13B:
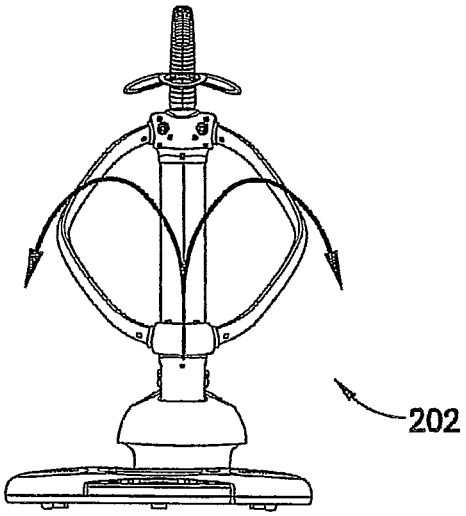
Figure 13C:
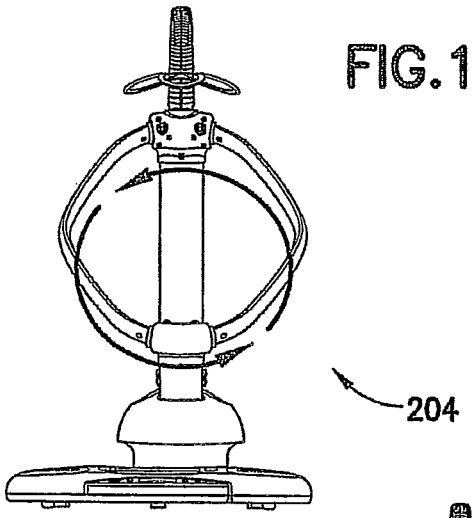
Figure 13D:
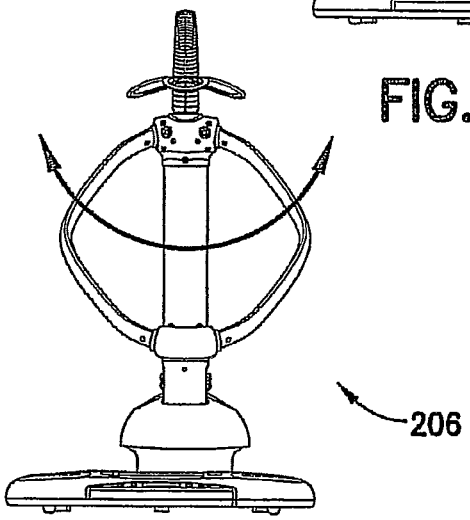
Figure 13E:
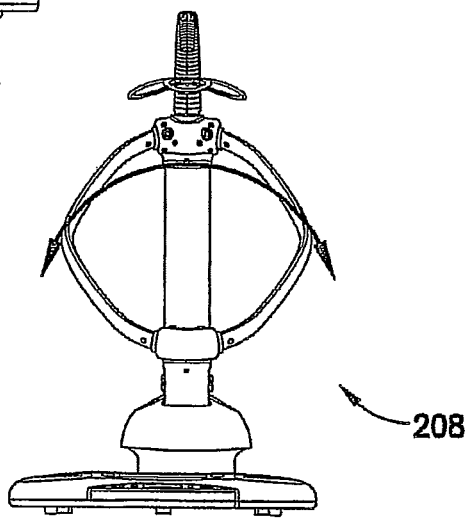

As a consequence of the foregoing description of the double scissor mechanism, when supporting platform 99, which is designed to support seating portion 9, is displaced in a vertically upward direction, both front and rear supporting and non-supporting members move in crossed fashion relative to the pivot pins such that the double scissor mechanism extends between rigid platform 65 and the upwardly displaced supporting platform 99 as illustrated by the successively increased supporting platform 99 height in FIGS. 8, 10, and 11.

Additionally, vertical reciprocating assembly 63 may be provided with at least one, and preferably two, resistive mechanical elements 123, such as a tension spring, fixably attached between lower ends 103L of second pair of spaced-apart parallel members 103, 103' and the lower ends 105L of third pair of spaced-apart parallel members 105, 105' whereby the upward vertical motion of vertical reciprocating assembly 63 is assisted by resistive mechanical element 123 because it pulls the relevant portions of the double scissor mechanism toward each other. The position of restrictive mechanical element 123 described above is not to be construed as limiting as the exact location of the attachment of resistive mechanical element 123 to the double scissor mechanism can be varied with similar results so long as it is attached to portions that get closer together as supporting platform 99 rises away from base 3 and it is attached in a way that assists that movement. Resistive mechanical element 123 also has the benefit of counteracting the effects of gravity because it acts to reduce downward movement when properly placed.

In yet another aspect, the resistive mechanical element 123 comprises a compression spring (not shown) placed in an advantageous position relative to vertical reciprocating assembly 63, such as between rigid platform 65 and supporting platform 99 in order to assist vertical expansion of the double scissor mechanism and resist vertical contraction of the double scissor mechanism.

With continued reference to FIGS. 8-12, a second motor 125 is mounted on rigid platform 65. Second motor 125 includes a drive shaft 127 operationally coupled to a worm gear drive assembly 129. Worm gear drive assembly 129 converts rotation of drive shaft 127 to a rotational movement of an output member 131 that is perpendicular to the rotation of drive shaft 127. A vertical yoke 133 is rotatably attached at a first end 135 thereof to output member 131 in a manner such that vertical yoke 133 raises and lowers an attachment member 137 attached to a second end 139 thereof along an axis y shown in FIG. 10. Attachment member 137 is fixedly coupled to supporting platform 99. Accordingly, this system allows a single motor (i.e., second motor 125) to move supporting platform 99 up and down with the motor only running in a single direction, thereby eliminating backlash in the system. The system for controlling vertical reciprocating assembly 63 to achieve the desired motion profile will be discussed in greater detail hereinafter. While vertical reciprocating assembly 63 has been illustrated and described herein as a double scissor mechanism, those skilled in the art will recognize that there are many other configurations to accomplish the same goal.

With reference to FIGS. 13A-13E, and with continued reference to FIGS. 1-12, a control system is provided to operatively control drive mechanism 59 so that it can move in at least one motion profile and, desirably, a plurality of pre-programmed motion profiles such as Car Ride 200, Kangaroo 202, Ocean Wave 204, Tree Swing 206, and Rock-A-Bye 208, as examples. These motion profiles are obtained by independently controlling the horizontal movement provided by horizontal reciprocating assembly 61 and the vertical movement provided by vertical reciprocating assembly 63 and then coordinating the horizontal and vertical movements to obtain visually distinctive motion profiles. However, these motion profiles are for exemplary purposes only and are not to be construed as limiting as any motion profile including horizontal and/or vertical motions may be utilized.

The control system of infant care apparatus 1 includes a controller, such as a microprocessor, a rheostat, a potentiometer, or any other suitable control mechanism, one or a plurality of control switches or knobs 141 for causing actuation of drive mechanism 59, and a variety of inputs and outputs operatively coupled to the controller. Since horizontal reciprocating assembly 61 and vertical reciprocating assembly 63 each include its own motor 79 and 125, respectively, horizontal reciprocating assembly 61 can be controlled independently of vertical reciprocating assembly 63 to obtain a variety of motion profiles that include both horizontal and vertical motion.

The control system desirably includes a variety of input sensors. For example, the control system may include a horizontal encoder 143 coupled to a back shaft 145 of first motor 79. Horizontal encoder 143 may include an infrared (IR) sensor 147 and a disk 149 with single hole or slot 151 positioned thereon (see FIG. 7). Horizontal encoder 143 allows the controller to determine the speed and number of revolutions of first motor 79. A vertical encoder 153 may also be provided and is configured to be coupled to a back shaft 155 of second motor 125. Vertical encoder 153 may include an IR sensor 157 and a disk 159 with single hole or slot 161 positioned thereon (see FIG. 11). Vertical encoder 153 allows the controller to determine the speed and number of revolutions of second motor 125 easily and inexpensively.

Horizontal and vertical limit switches 165, 167 may also be provided to provide inputs to the controller that rigid platform 65 has passed over an end of travel and that supporting platform 99 has passed over an end of travel, respectively. In addition, vertical limit switch 167 indicates when vertical reciprocating assembly 63 is in its lowest position and horizontal limit switch 165 indicates when horizontal reciprocating assembly 61 is at its furthest point to the right when viewed from the front. Horizontal and vertical limit switches 165, 167 allow the control system to quickly determine the initial position of the horizontal reciprocating assembly 61 and the vertical reciprocating assembly 63 and to adjust for error in drive mechanism 59 as discussed in greater detail hereinafter. These limit switches 165, 167 may be embodied as optical switches.

An overcurrent protection circuit detection input (not shown) may also be provided to the controller in order to prevent the electronics from being damaged. For instance, if too much current is drawn, circuitry may be provided that diverts power from second motor 125 if current exceeds a threshold. Additional circuitry detects whether this protection circuit has been tripped. Finally, control switches 141 may include user input buttons such as a main power button, a start/stop button, a motion increment button, a motion decrement button, a speed increment button, a speed decrement button, and the like.

The controller of the control system may also include a variety of outputs. These outputs include, but are not limited to: (1) Pulse Width Modulation (PWM) for first motor 79, (2) PWM for second motor 125, (3) display 56 backlight, which can be turned on and off independently in order to conserve power, (4) display 56 segments, and (5) power to IR lights of IR sensors 147, 157 of encoders 143, 153, which can be turned on and off to conserve power when infant care apparatus 1 is not in use.

The following explanation provides an understanding of an exemplary control system of infant care apparatus 1. Based on the physical limitations of first and second motors 79, 125 of horizontal and vertical reciprocating assemblies 61, 63, the maximum speed of first motor 79 may be about a four second period and the maximum speed of second motor 125 may be about a two second period. Based on these constraints, the following relationships may be established:

TABLE 1

| | Car Ride | Kangaroo | Tree Swing | Rock-a-Bye | Ocean Wave |
|---|---|---|---|---|---|
| Number of Vertical Cycles per Horizontal Cycle (n) | 2 | 4 | 2 | 2 | 1 |
| Phase offset (Φ) | 90 degrees | 0 degrees | 180 degrees | 0 degrees | 90 degrees |
| Horizontal period at min speed | 8 seconds | 12 seconds | 8 seconds | 8 seconds | 8 seconds |
| Horizontal period at max speed | 4 seconds | 8 seconds | 4 seconds | 4 seconds | 4 seconds |

The speed of first motor 79 is independently set to a correct period and a feedback control loop is used to ensure that first motor 79 remains at a constant speed despite the dynamics of the components of infant care apparatus 1. As mentioned above, the output of the control system is a PWM signal for first motor 79. One possible input for the control system is velocity of first motor 79, which can be observed from the speed of first motor 79 as observed by horizontal encoder 143. However, in order to avoid computationally expensive calculations, it is possible to operate in the frequency domain and use the number of processor ticks between ticks of horizontal encoder 143 as the input variable. This allows the calculations of the controller to be limited to integers rather than manipulating floats.

The physical drive mechanism of horizontal reciprocating assembly 61 is slide crank assembly 83 as described in greater detail hereinabove. Slide crank assembly 83 allows a single motor (i.e., first motor 79) to slide rigid platform 65 back and forth without the need to change directions. Since first motor 79 is only required to run in one direction, the effect of backlash is eliminated in the system, thereby removing problems with horizontal encoder 143 on back shaft 145 of first motor 79.

It is known that the natural soothing motions a person uses to calm a baby are a combination of at least two motions that each move in a reciprocating motion that has a smooth acceleration and deceleration such that the extremes of the motion slow to a stop before reversing the motion and are fastest in the middle of the motion. This motion is the same as that generated from a sinusoidal motion generated from the combination of the slide crank assembly 83 and the worm gear drive assembly 129. Slide crank assembly 83 and worm gear drive assembly 129 allow the driving motors to run at a constant rotational speed while the output motion provided to seat portion 9 slows and speeds up, mimicking the motion of a person soothing a child. These assemblies also allow the driving motors to run in one direction.

Figure 14:
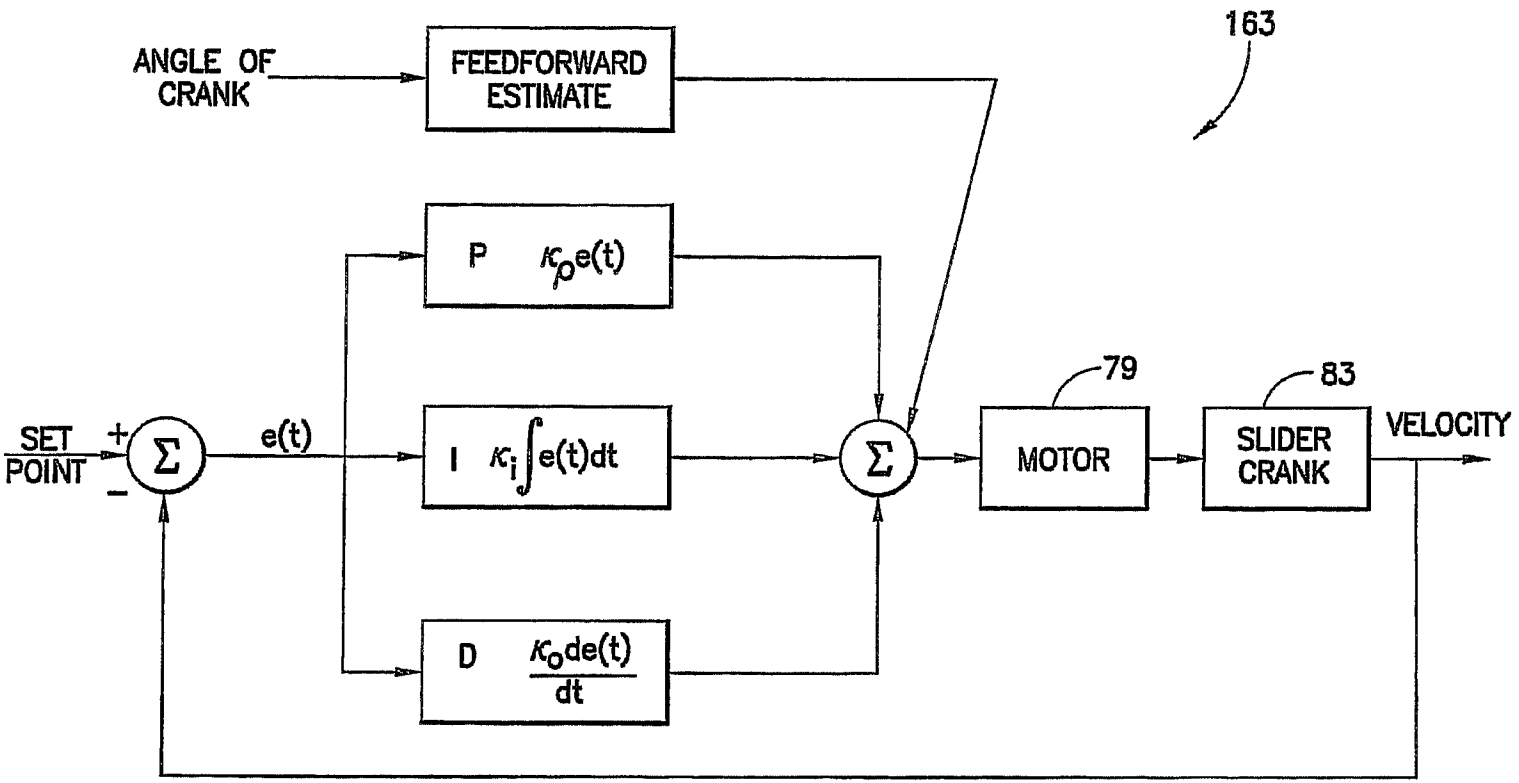
FIG. 14 is a block diagram of an exemplary control system for use with the infant care apparatus of the present invention.

With reference to FIG. 14, the torque on first motor 79 depends on the friction of the entire system (which is dependent on weight) and the angle of crank member 89. The torque of first motor 79 is controlled by setting the PWM to a predetermined value based on the desired velocity set by the user. A PID controller 163 with feed forward compensation can be used to control the velocity of first motor 79.

Any of the components shown in FIG. 14 may be set to zero. For example, reasonable accuracy is achieved using only proportional and integral terms where the constants $K_p$ and $K_i$ are dependent on the input speed, ignoring the feed forward and derivative terms.

Based on the feedback from horizontal encoder 143 and horizontal limit switch 165, the exact position of rigid platform 65 (denoted "hPos") can be determined at any point in its range of motion. Similarly, based on feedback from vertical encoder 153 and vertical limit switch 167, the exact position of supporting platform 99 (denoted "vPos") can be determined at any point in its range of motion.

While the control of rigid platform 65 is based entirely on velocity, the control of supporting platform 99 is based upon both position and velocity. For a given horizontal position (hPos) and a given motion, which dictates the number of vertical cycles per horizontal cycles (n) and phase offset (Φ) as shown in Table 1, the desired vPos can be calculated as follows:

$$\text{Desired_}v\text{Pos}=h\text{Pos}\times v2h\text{_ratio}\times n+\Phi \quad \text{(Equation 1)}$$

where v2h_ratio is a constant defined as the number of vertical encoder ticks per cycle divided by the number of horizontal encoder ticks per cycle. Based on the actual vertical position, the amount of error can be calculated as follows:

$$\text{posErr}=v\text{Pos}-\text{Desired_}v\text{Pos} \quad \text{(Equation 2)}$$

This error term must be correctly scaled to +/− verticalEncoderTicksPerCycle/2.

As an aside, if the direction of motion in Ocean Wave 204 and Car Ride 200 is irrelevant, there are two possibilities for Desired_vPos for each value of hPos and we can base the vertical error term, posErr, on the closer of the two.

The positional error term, posErr, must then be incorporated into a velocity based feedback control loop. Logically, if the vertical axis is behind (posErr<0), velocity should be increased while if the vertical axis is ahead (posErr>0), velocity should be decreased in proportion to the error as follows:

$$vSP=\text{posErr}\times K_{VP}+v\text{Base} \quad \text{(Equation 3)}$$

where $$vBasw=\frac{hSP}{n}\times \text{h2v_ratio} \quad \text{(Equation 4)}$$

and h2v_ratio is defined as the horizontal ticks per cycle/vertical ticks per cycle.

The above description is for exemplary purposes only as any suitable control scheme may be utilized. Many possible improvements can be made to this logic. For example, if the control system is too far behind to catch up within some threshold, the controller may be programmed to slow down the vertical axis instead of speeding up. Alternatively, in some situations, it may be desirable to slow down the horizontal axis until the vertical axis is able to synchronize. In addition, while horizontal encoder 143 and vertical encoder 153 were described hereinabove, this is not to be construed as limiting as magnetic encoders, as well as other types of encoders well known in the art may also be used. It may also be desirable to provide an arrangement in which two or more control switches associated with respective motors are required to both be actuated to effect speed control in the desired direction. Furthermore, while it was described that horizontal encoder 143 and vertical encoder 153 only include a single slot, this is not to be construed as limiting as encoders with a plurality of slots may be utilized. However, this disclosure advantageously uses single slot encoders to obtain high resolution feedback while lowering manufacturing costs.

In an exemplary embodiment, infant care apparatus 1 is configured to reciprocate the seat with a vertical displacement of 1.5 inches and a horizontal displacement of 3.0 inches with a vertical displacement frequency range of between about 10 and 40 cycles per minute and a horizontal displacement frequency range of between about 10 and 40 cycles per minute.

In another aspect, a third reciprocation means (not shown) may be added to enable reciprocation of the seat in a third direction orthogonal to the horizontal and vertical directions referenced herein. In one such embodiment, an additional platform would be placed either above or below the horizontal reciprocating assembly 61 to reciprocate the entire drive mechanism 59 in a horizontal direction that is perpendicular to the movement of horizontal reciprocating assembly 61. Using another slide crank assembly drawing power from either an existing motor or an additional motor, infant care apparatus 1 provides three-dimensional movement for an infant, opening up a multitude of additional motion profiles such as mimicking the motion of a traditional swing, for example.

Although an infant care apparatus has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements. For example, it is to be understood that this disclosure contemplates that, to the extent possible, one or more features of any embodiment can be combined with one or more features of any other embodiment.

The invention claimed is:

1. An infant care apparatus comprising:

a base;

a drive mechanism disposed on the base;

a support device coupled to the drive mechanism, the support device comprising: a seating portion; an arcuate seat support tube extending from one end of the seating portion to another end of the seating portion; and a housing comprising a supportive housing passage that supports the seat support tube; and a locking mechanism that secures the seat support tube within the supportive housing passage when the locking mechanism is engaged and allows the seat support tube to slide along at least a portion of the passage when the locking mechanism is disengaged, wherein the locking mechanism comprises a linkage interconnecting a first wedge-shaped recline locker with a second wedge-shaped recline locker, and a camming mechanism attached to one of the recline lockers such that the camming mechanism actuates one or both recline lockers via the linkage and moves the recline lockers toward or away from each other and either into or out of wedged engagement with the arcuate seat support tube, such that said wedged engagement presses the arcuate seat support tube against an interior surface of the supportive housing passage.

2. The infant care apparatus of claim 1, further comprising a controller electronically coupled to the drive mechanism for controlling the drive mechanism.

3. The infant care apparatus of claim 2, wherein the controller comprises a user interface that is configured to receive user input to control movement of the drive mechanism.

4. The infant care apparatus of claim 2, wherein a seat recline security switch detects whether the locking mechanism has engaged the seat support tube within the housing passage.

5. The infant care apparatus of claim 4, wherein the controller disables the drive mechanism if the locking mechanism is disengaged.

6. The infant care apparatus of claim 1, wherein the drive mechanism comprises a first motion assembly and a second motion assembly.

7. The infant care apparatus of claim 6, wherein the first motion assembly comprises: a stage having a lower surface facing the base and an upper surface facing opposite the lower surface; and a first motor operatively connected to the stage.

8. The infant care apparatus of claim 7, wherein the second motion assembly comprises a second motor disposed on the upper surface of the stage of the first motion assembly.

9. The infant care apparatus of claim 8, wherein operation of the first motor imparts motion in a first direction to the stage and operation of the second motor imparts motion in a second direction to the support device.

10. The infant care apparatus of claim 1, wherein the seating portion has a substantially elliptical shape.

11. The infant care apparatus of claim 1, wherein the support device further comprises:

a toy bar having a first end positioned adjacent to one end of the seating portion and a second end extending over the seating portion.

12. An infant care apparatus comprising:

a base; and a support device supported by the base, the support device comprising: a seating portion; an arcuate seat support tube extending from one end of the seating portion to another end of the seating portion; and a housing comprising a supportive housing passage that supports the seat support tube, a locking mechanism that secures the seat support tube within the supportive housing passage when engaged and allows the seat support tube to slide along at least a portion of the passage when disengaged, wherein the locking mechanism comprises a linkage interconnecting a first wedge-shaped recline locker with a second wedge-shaped recline locker, and a camming mechanism attached to one of the recline lockers such that the camming mechanism actuates one or both recline lockers via the linkage and moves the recline lockers toward or away from each other and either into or out of wedged engagement with the arcuate seat support tube, such that said wedged engagement presses the arcuate seat support tube against an interior surface of the supportive housing passage, wherein the arcuate seat support tube is slidingly engaged within at least a portion of the supportive housing passage such that the arcuate seat support tube slides along at least the portion of the supportive housing passage from at least a first position to at least a second position to change an orientation of the seating portion.

13. The infant care apparatus of claim 12, wherein the seating portion has a substantially elliptical shape.

14. The infant care apparatus of claim 12, wherein the support device further comprises:

a toy bar having a first end positioned adjacent to one end of the seating portion and a second end extending over the seating portion.

15. The infant care apparatus of claim 12, further comprising:

a drive mechanism disposed between the base and the support device for imparting motion to the support device.

16. The infant care apparatus of claim 15, wherein the drive mechanism comprises a first motion assembly and a second motion assembly.

17. The infant care apparatus of claim 16, wherein the first motion assembly comprises: a stage having a lower surface facing the base and an upper surface facing opposite the lower surface; and a first motor operatively connected to the stage.

18. The infant care apparatus of claim 17, wherein the second motion assembly comprises a second motor disposed on the upper surface of the stage of the first motion assembly.

19. The infant care apparatus of claim 18, wherein operation of the first motor imparts motion in a first direction to the stage and operation of the second motor imparts motion in a second direction to the support device.

20. The infant care apparatus of claim 15, further comprising a controller electronically coupled to the drive mechanism.

* * * * *